US008280081B2

(12) United States Patent
Lin et al.

(10) Patent No.: US 8,280,081 B2
(45) Date of Patent: Oct. 2, 2012

(54) ELECTRODE CONNECTION STRUCTURE OF SPEAKER UNIT

(75) Inventors: Yu-Min Lin, Changhua County (TW); Chang-Ho Liou, Changhua County (TW); Yu-Wei Huang, Taichung County (TW); Ming-Daw Chen, Hsinchu (TW); Rong-Shen Lee, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 779 days.

(21) Appl. No.: 12/344,270

(22) Filed: Dec. 25, 2008

(65) Prior Publication Data

US 2010/0034402 A1 Feb. 11, 2010

(30) Foreign Application Priority Data

Aug. 11, 2008 (TW) ..... 97130533 A

(51) Int. Cl.
*H04R 25/00* (2006.01)

(52) U.S. Cl. ..... 381/191; 381/150; 381/190; 381/173

(58) Field of Classification Search ..... 381/150, 381/173, 190, 191
See application file for complete search history.

(56) References Cited

U.S. PATENT DOCUMENTS 7,141,919 B1 11/2006 Hamada et al.

FOREIGN PATENT DOCUMENTS

| | | |
|---|---|---|
| CN | 1467974 | 1/2004 |
| JP | 2003-078995 | 3/2003 |
| TW | 200726300 | 7/2007 |

OTHER PUBLICATIONS

"Office Action of Taiwan Counterpart Application", issued on Oct. 25, 2011, p. 1-p. 9.
"First Office Action of China Counterpart Application", issued on Apr. 1, 2012, p. 1-p. 6.

*Primary Examiner* — Ha Tran T Nguyen
*Assistant Examiner* — Suberr Chi
(74) *Attorney, Agent, or Firm* — Jianq Chyun IP Office

(57) ABSTRACT

An electrode connection structure of a speaker unit is provided. The speaker unit includes at least one electrode layer, which is made of a conductive material, or made of a non-conductive material with a conductive layer formed on a surface thereof. The electrode connection structure includes a conductive electrode and an adhesive material. The conductive electrode is used for providing power supply signals for the speaker unit to generate sounds. The adhesive material adheres the conductive electrode in parallel with a surface of the electrode layer. The adhesive material has adhesive characteristics, so as to electrically connect the conductive electrode and the electrode layer, in which the adhesive material is adhered to a side of the surface of the electrode layer closely adjacent to the conductive electrode with a certain area.

21 Claims, 8 Drawing Sheets

ELECTRODE CONNECTION STRUCTURE OF SPEAKER UNIT

CROSS-REFERENCE TO RELATED APPLICATION

This application claims the priority benefit of Taiwan application serial no. 97130533, filed on Aug. 11, 2008. The entirety of the above-mentioned patent application is hereby incorporated by reference herein and made a part of this specification.

BACKGROUND OF THE INVENTION

1. Field of the Invention

The present invention generally relates to a speaker unit structure, in particular, to a speaker unit with a sound cavity structure having characteristics of being light, thin, flexible, and the like.

2. Description of Related Art

The two most direct sensory systems of human being are visual and audible systems, so for a long time, scientists try their best to develop related elements or system techniques. Recently, electroacoustic speakers are mainly classified into direct and indirect radiating types, and are approximately classified into moving coil, piezoelectric, and electrostatic speakers according to driving manners. The speakers each mainly include an electrode, a vibrating membrane, and a sound cavity in despite of the type thereof.

The electrodes of conventional electric speakers are mostly thin metal plates, and a metal line is connected to an external signal source by tin/lead-soldering the contacts of the electrodes. However, under the trend of fine 3C products and flat family cinemas, flat speakers become popular. Moreover, flexible electronics are tend towards being light, thin, and flexible etc., and in order to enable the flat speaker to have the above characteristics, the structure and the material of the speaker must be considered. A conventional thin metal plate is replaced by a thin electrode fabricated by cladding a conductive layer on a substrate made of high molecular material or paper, such that the whole speaker becomes lighter, thinner, and more flexible. However, in the conventional electrode connection structure of the electrode contact and the metal line, a temperature of the used tin/lead-soldering is up to higher than 180° C., so the electrode having the substrate made of high molecular material or paper may have its substrate deformed or curled due to the heat, or even have the opened contacts. Further, the rigidness of the contact structure of the tin/lead-soldering is too high to be flexible, such that it is impossible to meet the demand of the flexible electronics.

Referring to FIGS. 1A and 1B, a structural cross-sectional view and a schematic top view of a piezoelectric electroacoustic transducer in U.S. Pat. No. 7,141,919 are shown. A piezoelectric sounding body 1 includes a metal plate 2, an insulation layer 3, and a piezoelectric body 4. The piezoelectric sounding body 1 is located on a supporting portion 21 of a case 20, and is spaced from a terminal 22 through a spacing wall portion 24. An insulation material 32 is used for fixing the metal plate 2 on the supporting portion 21, and a conductive adhesive 33 is used for fixing the piezoelectric body 4 on the insulation layer 3, and connecting to the terminal 22.

The piezoelectric electroacoustic transducer enables the vibrating membrane to vibrate by using a piezoelectric material, so as to generate sounds. The connecting position of the conductive adhesive 33 and the terminal 22 may be clearly known from FIG. 1B, the connection between the conductive adhesive 33 and the terminal 22 is a point connection manner, and the structure of the conductive adhesive 33 and the terminal 22 forms a vertical connection. The rigidness of the whole structure is too high to be flexible, such that it is impossible to meet the demand of the flexible electronics.

SUMMARY OF THE INVENTION

Accordingly, the present invention is directed to a sound cavity structure having characteristics of being light, thin, flexible and so on, which is applicable to a speaker unit structure, and includes a sound cavity substrate and a corresponding supporting body designed thereof.

In an embodiment, the present invention provides an electrode connection structure of a speaker unit. The speaker unit includes at least one electrode. The electrode connection structure includes a conductive electrode and an adhesive material. The conductive electrode is used for providing power supply signals for the speaker unit to generate sounds. The adhesive material adheres the conductive electrode in parallel on a surface of the electrode. The adhesive material has adhesive characteristics, so as to electrically connect the conductive electrode to the electrode, in which the adhesive material is adhered to a side of the surface of the electrode closely adjacent to the conductive electrode with a certain area.

In an embodiment, the adhesive material is a conductive adhesive material, and the adhesive material is adhered to a side of the surface of the electrode closely adjacent to the conductive electrode with a certain area, such that the power supply signals transmitted by the conductive electrode are uniformly transmitted to the electrode.

In an embodiment, the adhesive material is a conductive adhesive material, and the adhesive material is formed on a surface of the conductive electrode, such that the conductive electrode with the adhesive material is adhered in parallel on the surface of the electrode, so as to achieve an electrical connection.

In an embodiment, the adhesive material is a conductive adhesive material, and the adhesive material extends to a whole surface of the conductive electrode, such that the power supply signals transmitted by the conductive electrode are transmitted to the electrode.

In an embodiment, the conductive electrode is made of a metal or a conductive organic material.

In an embodiment, a surface of the electrode connected to the conductive electrode includes an uneven structure, the adhesive material is a non-conductive adhesive material, and a protruding part of the uneven structure of the electrode is electrically connected to the conductive electrode by the use of contraction and curing generated from heating the adhesive material.

In an embodiment, the speaker unit further includes a protection layer, formed on an external side of a conductive electrode package structure formed by the electrode, the conductive electrode, and the adhesive material, so as to protect the conductive electrode package structure. The protection layer is a protection tape or is formed by directly coating a liquid overcoat.

In an embodiment, the present invention provides an electrode connection structure of a speaker unit. In the electrode connection of the speaker unit, the speaker unit includes at least one electrode layer, and the electrode layer includes a non-conductive material layer and a conductive thin film formed on a surface thereof. The electrode connection structure includes a conductive electrode and an adhesive material. The conductive electrode is used for providing power supply signals for the speaker unit to generate sounds. The adhesive material adheres the conductive electrode in parallel on a surface of the conductive thin film. The adhesive material has adhesive characteristics, so as to electrically connect the conductive electrode to the conductive thin film, in which the adhesive material is adhered to a side of the surface of the conductive thin film closely adjacent to the conductive electrode with a certain area.

In an embodiment, the non-conductive material is made of one selected from among plastic, rubber, paper, and non-conductive cloth.

In an embodiment, the conductive thin film is made of one selected from among a pure metal material such as aluminium, gold, silver, and copper, or an alloy thereof, a bi-metal material, a conductive oxide material such as indium tin oxide (ITO) and indium zinc oxide (IZO), high molecular conductive material PEDOT, and a combination thereof.

In order to have a further understanding of the features and the advantages of the present invention, a detailed description is given as follows with the embodiments and the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
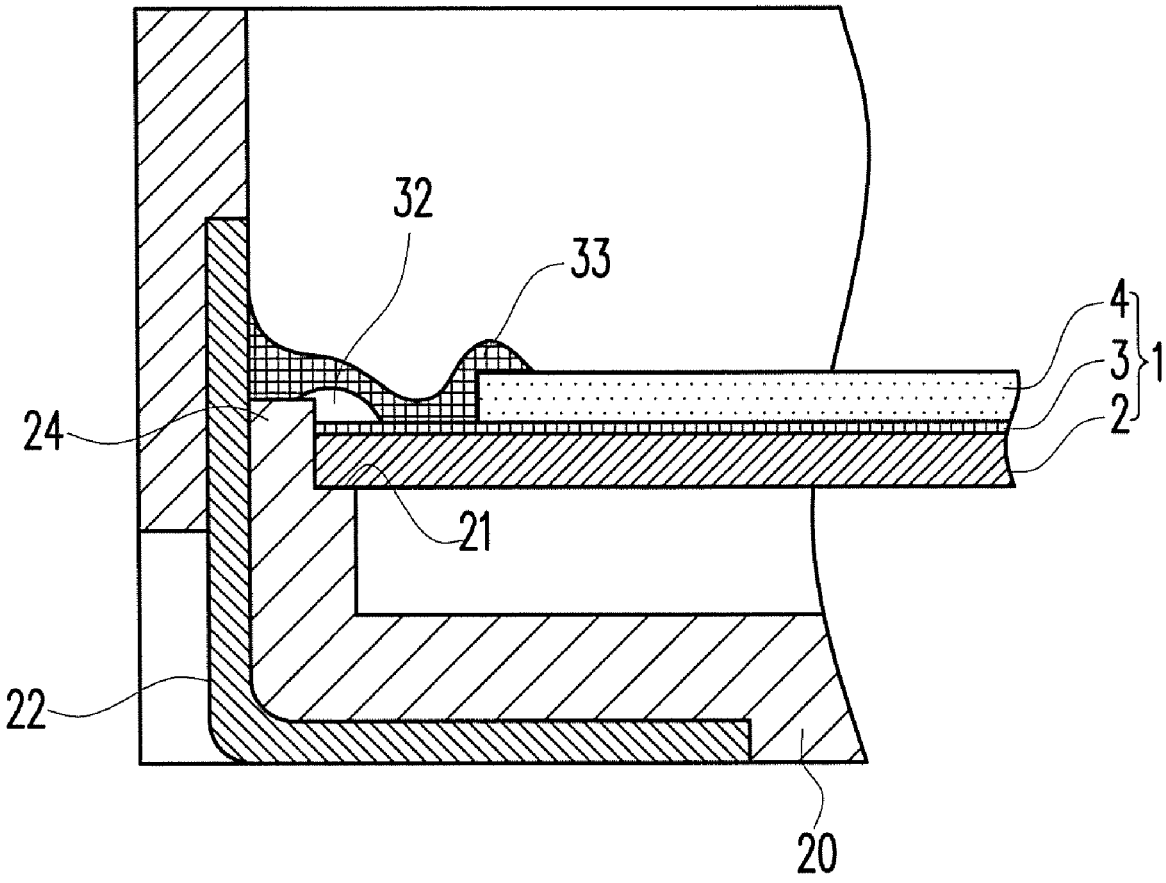
FIG. 1A (PRIOR ART)
FIGS. 1A and 1B are a structural cross-sectional view and a schematic top view of a conventional piezoelectric electroacoustic transducer.
Figure 1B:
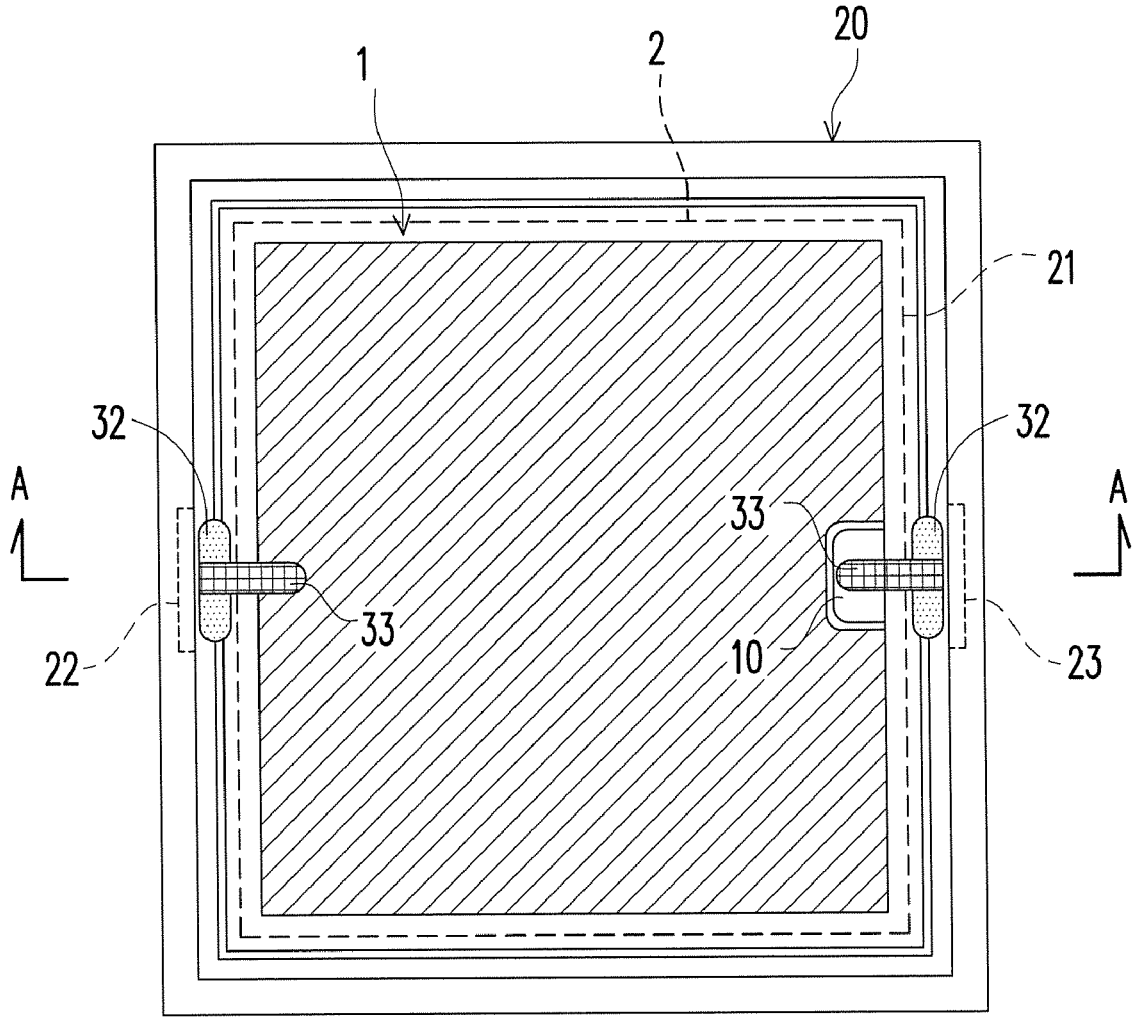
FIG. 1B (PRIOR ART)

Reference will now be made in detail to the present embodiments of the invention, examples of which are illustrated in the accompanying drawings. Wherever possible, the same reference numbers are used in the drawings and the description to refer to the same or like parts.

The present invention provides a conductive electrode package structure design applied to a flat thin speaker. In the structure, an adhesive material is used to adhere an electrode and an externally connected conductive electrode, so as to greatly reduce the effect of the conventional high temperature soldering process on the substrate made of high molecular material or paper of the speaker. An adhesive material body is high molecular polymer, therefore, after the electrode is bonded, the contacts may be still flexible. Therefore, the structure of the flat speaker is light, thin, and flexible, and the flat speaker may be assembled quickly and repeatedly, and bonded with low temperature.

Figure 2A:
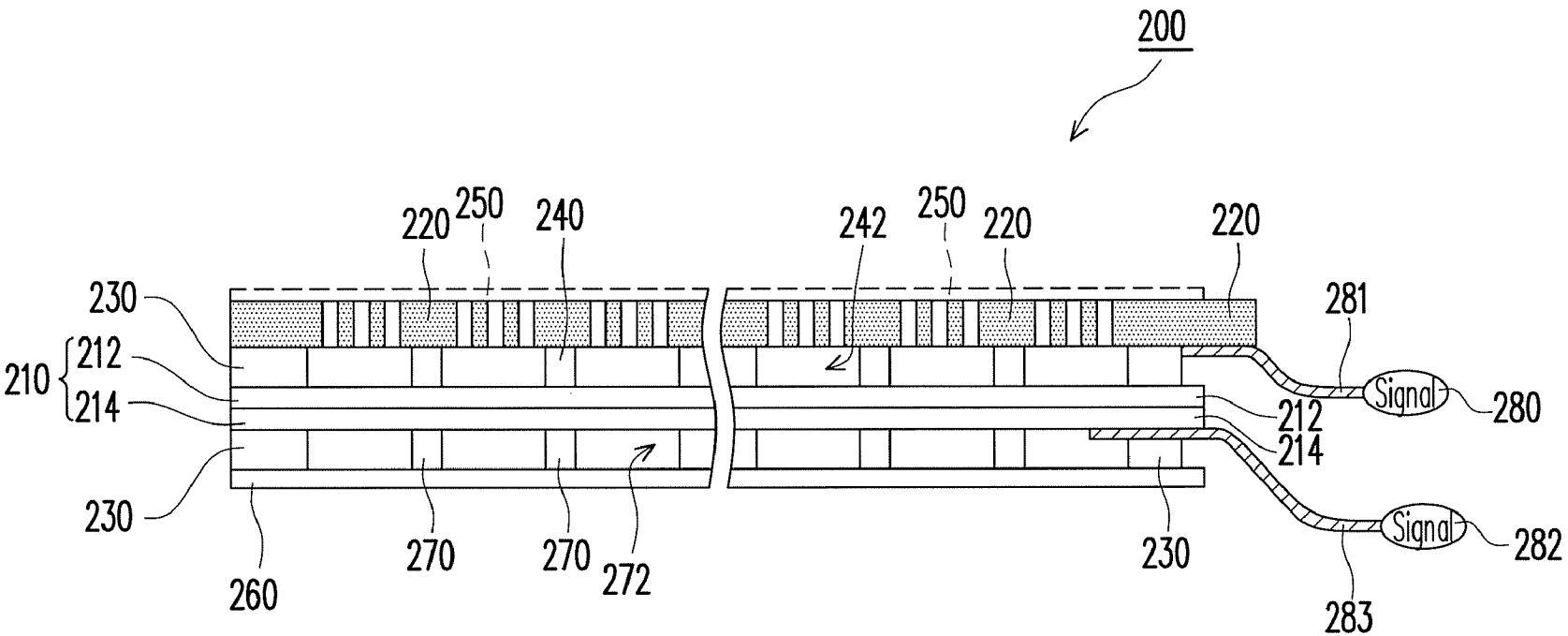
FIG. 2A shows a speaker unit structure applying a conductive electrode package structure design according to an embodiment of the present invention.

Referring to FIG. 2A, a speaker unit structure applying a conductive electrode package structure design according to an embodiment of the present invention is shown. A speaker unit structure 200 includes a vibrating membrane 210, an electrode layer 220 having a plurality of openings, a frame supporting body 230, and a plurality of supporting bodies 240 located between the electrode layer 220 and the vibrating membrane 210. The other side of the vibrating membrane 210 facing the electrode layer 220 has a sound cavity structure, and the sound cavity structure is composed of a sound cavity substrate 260 and a sound cavity supporting body 270 located between the vibrating membrane 210 and the sound cavity substrate 260. The vibrating membrane 210 includes an electret layer 212 and a metal thin film electrode 214. A lateral side of the electret layer 212 is connected to the frame supporting body 230 and the supporting body 240, and the other lateral side is electrically connected to the metal thin film electrode 214.

The electrode layer 220 having the plurality of openings is made of a conductive material, for example, metal (such as iron, copper, and aluminum, or an alloy thereof) or conductive cloth (such as metal fiber, oxide metal fiber, carbon fiber, or graphite fiber).

A material of the electret layer 212 may be a dielectric material. The dielectric material may keep static charges for a long time after being electrized, and may generate a ferroelectric effect in the material after being charged, such that it may be considered as an electret vibrating membrane layer. The electret layer 212 may be fabricated by using single-layer or multi-layer dielectric material, and the dielectric material may be, for example, fluorinated ethylenepropylene (FEP), polytetrafluoethylene (PTFE), polyvinylidene fluride (PVDF), some fluorine polymer, and other appropriate materials, and the dielectric material includes holes with a micrometer or nano-micrometer aperture. The electret layer 212 is a vibrating membrane capable of keeping the static charges and piezoelectricity for a long time after the dielectric material is electrized, and may include nano-micrometer holes to increase light transmittance and piezoelectricity. Therefore, dipolar charges are generated after being charged by means of corona, thereby generating a ferroelectric affect.

In order not to affect tension and vibration effect of the vibrating membrane 210, the metal thin film electrode 214 may be an extremely thin metal thin film electrode.

The electret layer 212 filled up with negative charges is set as an example for description. When an input sound source signal is respectively connected to the electrode layer 220 having the plurality of openings and the metal thin film electrode 214, when the input sound source signal is a positive voltage, it generates an attractive force with the negative charges of the electret vibrating membrane on the speaker unit, and when the sound source signal is a negative voltage, it generates a repulsive force with the positive charges on the unit, such that the vibrating membrane 210 moves.

On the contrary, when a voltage phase input of the sound source signal is changed, similarly the positive voltage generates the attractive force with the negative charges of the electret vibrating membrane on the speaker unit, and the negative voltage unit generates the repulsive force with the positive charges on the unit, the moving direction of the vibrating membrane 210 is opposite. When the electret vibrating membrane 210 moves towards different moving directions, the surrounding air is compressed to generate a sound output.

For the speaker unit structure 200 of this embodiment, one or two peripheral sides may be covered by an air-permeable and waterproof thin film 250, such as a GORE-TEX thin film of ePTFE material, so as to prevent the effect of water and oxygen from resulting in the leak of the charges of the electret layer 212 to affect the ferroelectric effect.

A working region of the vibrating membrane 210 is formed between the electrode layer 220 and the vibrating membrane 210 through the adjacent supporting bodies 240, that is, a cavity space 242 of the speaker for generating a resonant sound field is formed. A working region of the vibrating membrane 210 is formed between the sound cavity substrate 260 and the vibrating membrane 210 through the adjacent sound cavity supporting bodies 270, that is, a cavity space 272 of the speaker generating the resonant sound field is formed. No matter for the supporting bodies 240 or the sound cavity supporting bodies 270, the disposing manner, the height, and other designs may be adjusted according to the requirements on design. In addition, the number of the sound cavity supporting bodies 270 may be equal to, less than, or more than that of the supporting bodies 240. The supporting bodies 240 or the sound cavity supporting bodies 270 may be respectively fabricated on the electrode layer 220 or the sound cavity substrate 260.

In the conductive electrode package structure provided by the present invention, the conductive electrode 281 and the conductive electrode 283 are respectively connected to the electrode layer 220 and the metal thin film electrode 214. The shape of the conductive electrodes 281 and 283 may be an strip shape, a sheet shape, a linear shape, or any other geometrical shape, as long as the connecting area is larger than the enough contacting area required on design. The larger the contacting area results in a relatively lower contacting resistance, such that the sound source signal may be uniformly transmitted to the electret vibrating membrane 210 through potential signals transmitted by the conductive electrodes 281 and 283, so as to generate a vibration with preferred efficiency to generate sounds.

That is to say, the conductive electrode 281 and the electrode layer 220 are electrically connected through the elongated large-area conductive adhesive material. The conductive electrode 281 is adhered under the electrode layer 220, that is, the elongated large-area conductive adhesive material adheres the conductive electrode 283 and the metal thin film electrode 214, so as to achieve the electrical connection. The conductive electrode 283 is adhered under the metal thin film electrode 214, and is fixed by the frame supporting body 230.

Figure 2B:
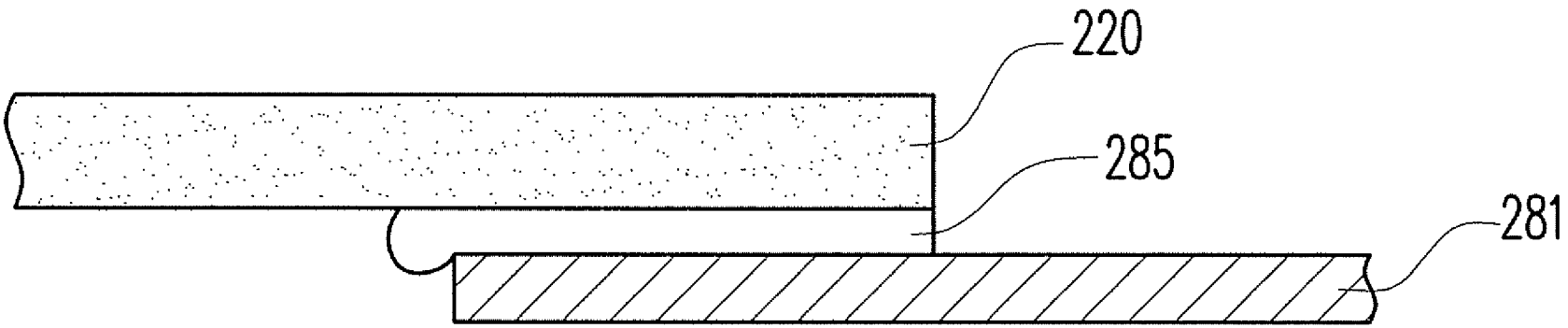
FIG. 2B is a schematic cross-sectional view of a connecting part between a conductive electrode and an electrode layer in the conductive electrode package structure of FIG. 2A.

The connecting relation between the conductive electrode 281 and the electrode layer 220 is set as an example, referring to FIG. 2B, the conductive adhesive material 285 is located between the conductive electrode 281 and the electrode layer 220. The conductive adhesive material 285 may be a conductive adhesive, an anisotropic conductive adhesive, or an isotropic conductive adhesive. The material of the conductive electrode 281 or 283 may be metal or conductive organic material. The conductive adhesive material 285 adheres the conductive electrode 281 and the electrode layer 220 by the use of a low temperature bonding manner.

In the design of the conductive electrode package structure, the speaker unit structure 200 may enable the vibrating membrane 210 to vibrate through the signals 280 and 282 transmitted by the conductive electrodes 281 and 283, so as to generate sounds. Seen from the package connection structure, the adhesive material adheres the electrode and the externally connected conductive electrode, so as to greatly reduce the effect of the conventional high temperature soldering process on the substrate made of high molecular material or paper of the speaker. The adhesive material body is a high molecular polymer, therefore, after the electrode is bonded, the contacts may be still flexible. Therefore, the structure of the flat speaker is light, thin, and flexible, and the flat speaker may be assembled quickly and repeatedly, and bonded with low temperature.

Figure 3A:
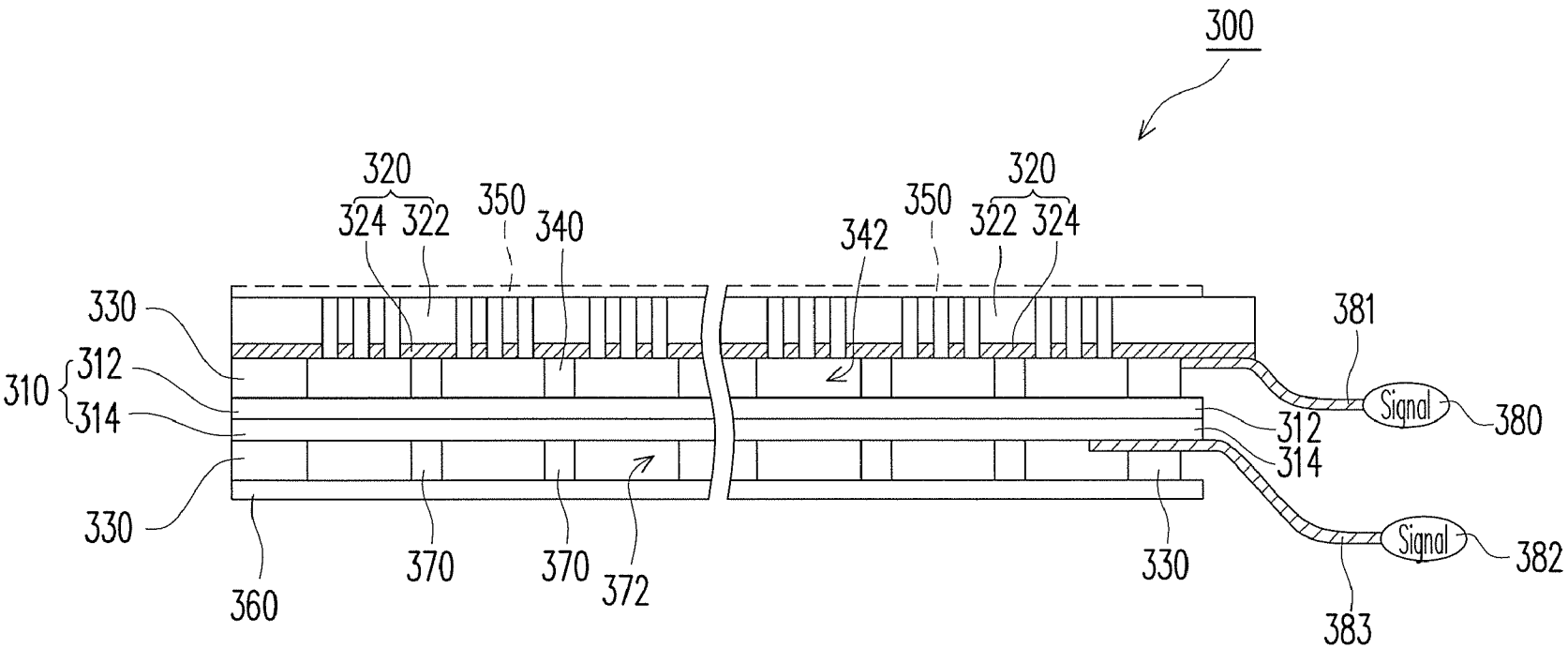
FIG. 3A shows a speaker unit structure applying the conductive electrode package structure design according to another embodiment of the present invention.

Referring to FIG. 3A, another speaker unit structure applying the conductive electrode package structure design according to the present invention is shown. A speaker unit structure 300 includes a vibrating membrane 310, an electrode layer 320 having a plurality of openings, a frame supporting body 330, and a plurality of supporting bodies 340 located between the electrode layer 320 and the vibrating membrane 310. A working region of the vibrating membrane 310 is formed between the electrode layer 320 and the vibrating membrane 310 through the adjacent supporting bodies 340, that is, a cavity space 342 of the speaker for generating a resonant sound field is formed. The other side of the vibrating membrane 310 facing the electrode layer 320 has a sound cavity structure, and the sound cavity structure is composed of a sound cavity substrate 360 and a plurality of sound cavity supporting bodies 370 located between the vibrating membrane 310 and the sound cavity substrate 360. Another working region of the vibrating membrane 310 is formed between the sound cavity substrate 360 and the vibrating membrane 310 through the adjacent supporting bodies 370, that is, a cavity space 372 of the speaker for generating a resonant sound field is formed. The vibrating membrane 310 includes an electret layer 312 and a metal thin film electrode 314, in which a lateral side of the electret layer 312 is connected to the frame supporting body 330 and the supporting body 340, and the other lateral side is electrically connected to the metal thin film electrode 314.

The materials of the electret layer 312 and the metal thin film electrode 314 are as shown in the embodiment of FIG. 2A, and thus will not be repeated. The electrode layer 320 of this embodiment is made of a non-conductive material 322 coated with a conductive thin film 324. The non-conductive material 322 may be plastic, rubber, paper, or non-conductive cloth such as cotton fibers and polymer fibers. The conductive thin film 324 may be a pure metal material such as aluminium, gold, silver, and copper, or an alloy thereof, or a bi-metal material such as Ni/Au. The conductive thin film 324 can also be made from a conductive oxide material such as indium tin oxide (ITO) and indium zinc oxide (IZO), a high molecular conductive material PEDOT, or a combination thereof.

In the conductive electrode package structure design provided by the present invention, the elongated large-area conductive adhesive material adheres the conductive electrode 381 and the conductive thin film 324 of the electrode layer 320, so as to achieve an electrical connection. The conductive electrode 381 is adhered under the conductive thin film 324. In addition, the elongated large-area conductive adhesive material adheres the conductive electrode 383 and the metal thin film electrode 314, so as to achieve an electrical connection. The conductive electrode 383 is adhered under the metal thin film electrode 314.

Figure 3B:
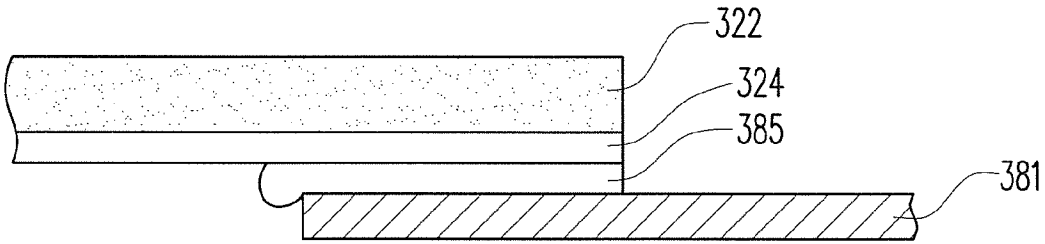
FIG. 3B is a schematic cross-sectional view of a connecting part between a conductive electrode and an electrode layer in the conductive electrode package structure of FIG. 3A.

The connecting relation between the conductive electrode 381 and the electrode layer 320 is set as an example, referring to FIG. 3B, the conductive adhesive material 385 is located between the conductive electrode 381 and the conductive thin film 324. The conductive adhesive material 385 may be a conductive adhesive, an anisotropic conductive adhesive, or an isotropic conductive adhesive. The material of the conductive electrode 381 or 383 may be metal or conductive organic material.

In the design of the conductive electrode package structure, the speaker unit structure 300 may enable the vibrating membrane 310 to vibrate through the signals 380 and 382 transmitted by the conductive electrodes 381 and 383, so as to generate sounds. Seen from the package connection structure, the adhesive material adheres the electrode and the externally connected conductive electrode, so as to greatly reduce the effect of the conventional high temperature soldering process on the substrate made of high molecular material or paper of the speaker. The adhesive material body is a high molecular polymer, therefore, after the electrode is bonded, the contacts may be still flexible. Therefore, the structure of the flat speaker is light, thin, and flexible, and the flat speaker may be assembled quickly and repeatedly, and bonded with low temperature.

Figure 3C:
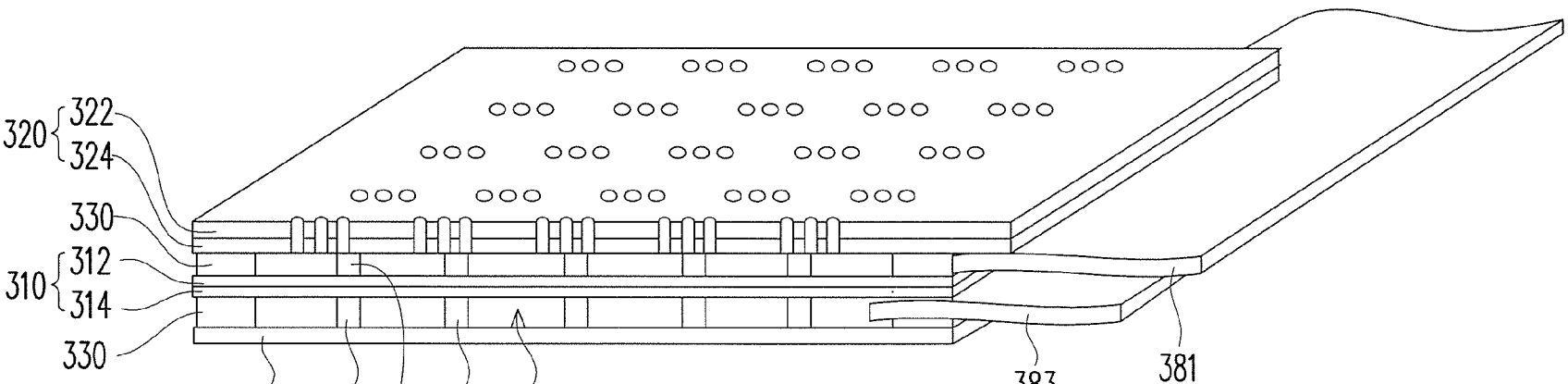
FIG. 3C is a lateral cross-sectional view of the conductive electrode package structure design of FIG. 3A.

FIG. 3C is a lateral cross-sectional view of the conductive electrode package structure design of FIG. 3A. It may be known from the drawing that the elongated large-area conductive adhesive material adheres the sheet conductive electrode 381 under the conductive thin film 324, such that the conductive electrode 381 is electrically connected to the conductive thin film 324 of the electrode layer 320. In addition, the elongated large-area conductive adhesive material adheres the conductive electrode 383 under the metal thin film electrode 314, such that the conductive electrode 383 is electrically connected to the metal thin film electrode 314.

Figure 4:
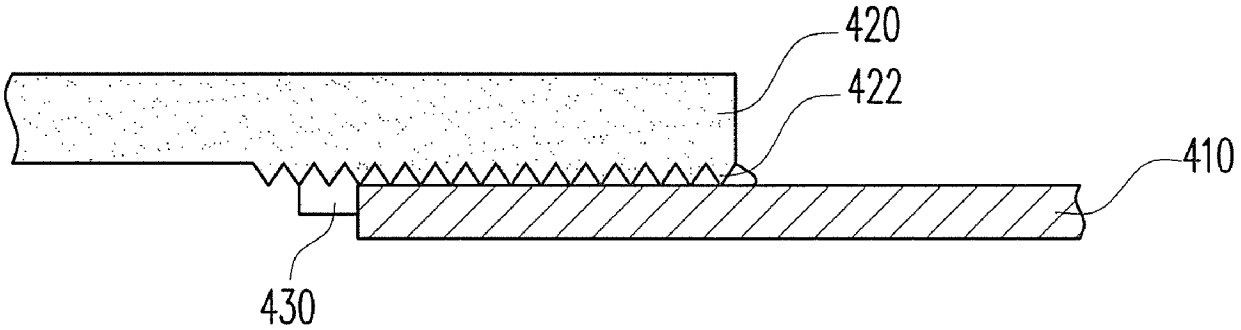
FIGS. 4-6 are schematic partial cross-sectional views of the speaker unit structures applying the conductive electrode package structure designs according to different embodiments of the present invention.

Referring to FIG. 4, another speaker unit structure applying the conductive electrode package structure design according to the present invention is shown, in which the connecting relation between a conductive electrode 410 and an electrode layer 420 is set as an example for description. In this embodiment, a non-conductive adhesive material 430 adheres the conductive electrode 410 under the electrode layer 420. In this embodiment, the structure under the electrode layer 420 must be an uneven structure 422 with roughness or protruding parts. When an external force is applied to adhere the conductive electrode 410 under the electrode layer 420, the conductive electrode 410 is then electrically connected to the electrode layer 420. The non-conductive adhesive material 430 may also adopt the material generating contraction and curing from a physical or a chemical action, such that after, for example, an ultraviolet (UV) is applied, the non-conductive adhesive material 430 is contracted, and the conductive electrode 410 is electrically connected to the electrode layer 420. The non-conductive adhesive material 430 may be an UV adhesive or an insulating adhesive.

Figure 5:
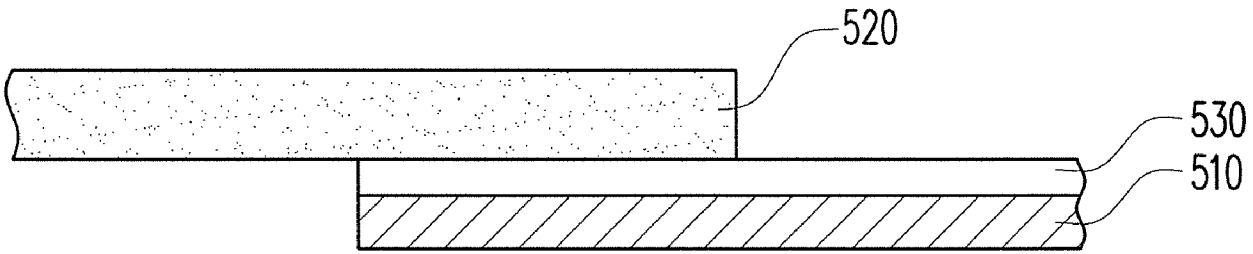

Referring to FIG. 5, a schematic partial cross-sectional view of further another speaker unit structure applying the conductive electrode package structure design according to the present invention is shown. In this embodiment, a conductive adhesive material 530 is directly disposed on one surface of a conductive electrode 510. When the conductive electrode 510 is connected to an electrode layer 520, the conductive adhesive material 530 may directly adhere the conductive electrode 510 under the electrode layer 520, so as to achieve an electrical connection.

Figure 6:
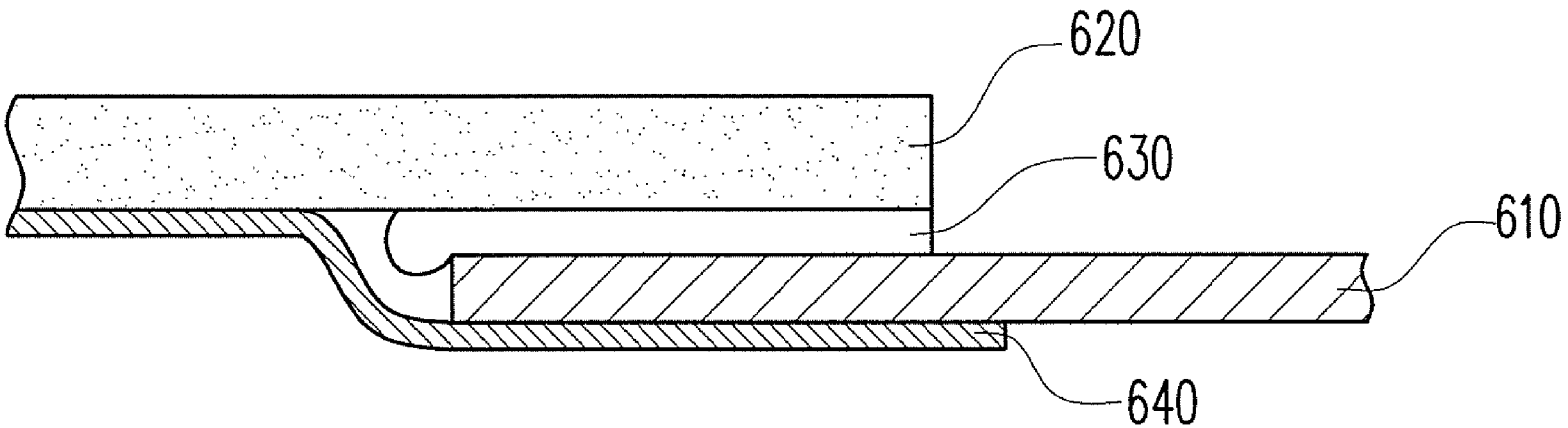

Referring to FIG. 6, a schematic partial cross-sectional view of still another speaker unit structure applying the conductive electrode package structure design according to the present invention is shown. A connecting relation between a conductive electrode 610 and an electrode layer 620 is set as an example, a conductive adhesive material 630 is located between the conductive electrode 610 and the electrode layer 620. The conductive adhesive material 630 adheres the conductive electrode 610 and the electrode layer 620. In order to protect the conductive electrode package structure, a protection layer 640 may be added on an external side, and the protection layer may be a protection tape, or may be formed by directly coating a liquid overcoat.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electrode connection structure of a speaker unit, wherein the speaker unit comprises an electrode with a plurality of openings, a vibrating membrane, and a plurality of supporting bodies disposed between the electrode and the vibrating membrane to form a cavity space as a working region for the vibrating membrane, the vibrating membrane comprising an electret layer and a metal thin film electrode, the electrode connection structure comprising:

a first conductive electrode and a second conductive electrode, both of which are electrically isolated from each other, for respectively providing sound source signals for the speaker unit to generate sounds;

a first adhesive material, adhering the first conductive electrode substantially in parallel on a surface of the electrode with the plurality of openings; and a second adhesive material, adhering the second conductive electrode substantially in parallel on a surface of the metal thin film electrode of the vibrating membrane, wherein the first adhesive material comprises adhesive characteristics, so as to electrically connect the first conductive electrode to the electrode with the plurality of openings, and the first adhesive material is adhered to a side of the surface of the first electrode closely adjacent to the conductive electrode with a first certain elongated area, and wherein the second adhesive material comprises adhesive characteristics, so as to electrically connect the second conductive electrode to the metal thin film electrode of the vibrating membrane, and the second adhesive material is adhered to a side of the surface of the second electrode closely adjacent to the metal thin film electrode of the vibrating membrane with a second certain elongated area.

2. The electrode connection structure of a speaker unit according to claim 1, wherein the first adhesive material and the second adhesive material are conductive adhesive materials, such that when the sound source signals are transmitted by the first conductive electrode and the second conductive electrode, the sound source signals are respectively and uniformly transmitted to the electrode with the plurality of openings and the metal thin film electrode of the vibrating membrane.

3. The electrode connection structure of a speaker unit according to claim 1, wherein the first adhesive material and the second adhesive material are conductive adhesive materials, and the first adhesive material and the second adhesive material are respectively directly disposed on a surface of the first conductive electrode for connecting to the electrode with the plurality of openings and on a surface of the second conductive electrode for connecting to the metal thin film electrode of the vibrating membrane.

4. The electrode connection structure of a speaker unit according to claim 1, wherein the first adhesive material and the second adhesive material are conductive adhesive materials, the first adhesive material extends to a whole surface of the first conductive electrode, and the second adhesive material extends to a whole surface of the second conductive electrode.

5. The electrode connection structure of a speaker unit according to claim 1, wherein the first adhesive material and the second adhesive material are conductive adhesive materials, wherein the conductive adhesive material is conductive adhesive, anisotropic conductive adhesive, or isotropic conductive adhesive.

6. The electrode connection structure of a speaker unit according to claim 1, wherein both of the first conductive electrode and the second conductive electrode are made of a metal or a conductive organic material.

7. The electrode connection structure of a speaker unit according to claim 1, wherein a surface of the electrode with the plurality of openings connected to the first conductive electrode comprises an uneven structure, the first adhesive material is a non-conductive adhesive material or an ultraviolet (UV) adhesive, and a protruding part of the uneven structure of the electrode with the plurality of openings is electrically connected to the first conductive electrode by the use of contraction and curing generated from a physical or a chemical action of the first adhesive material.

8. The electrode connection structure of a speaker unit according to claim 1, wherein a surface of the first conductive electrode connected to the electrode with the plurality of openings comprises an uneven structure, the first adhesive material is a non-conductive adhesive material, and a protruding part of the uneven structure of the first conductive electrode is electrically connected to the electrode with the plurality of openings by the use of contraction and curing generated from a physical or a chemical action of the adhesive material.

9. The electrode connection structure of a speaker unit according to claim 1, wherein connecting surfaces of the electrode with the plurality of openings and the first conductive electrode each comprise an uneven structure, the first adhesive material is a non-conductive adhesive material, and a protruding part of the uneven structure of the electrode with the plurality of openings is electrically connected to a protruding part of the uneven structure of the first conductive electrode by the use of contraction and curing generated from a physical or a chemical action of the adhesive material.

10. The electrode connection structure of a speaker unit according to claim 1, further comprising a protection layer, formed on an external side of a conductive electrode package structure formed by the electrode with the plurality of openings, the first conductive electrode, and the first adhesive material, so as to protect the conductive electrode package structure.

11. The electrode connection structure of a speaker unit according to claim 10, wherein the protection layer is a protection tape.

12. The electrode connection structure of a speaker unit according to claim 10, wherein the protection layer is formed by directly coating a liquid overcoat.

13. The electrode connection structure of a speaker unit according to claim 1, wherein the first conductive electrode and the second conductive electrode are strip shaped, sheet shaped, or linear shaped.

14. The electrode connection structure of a speaker unit according to claim 1, wherein the electrode with the plurality of openings is made of metal or conductive cloth.

15. The electrode connection structure of a speaker unit according to claim 14, wherein the electrode with the plurality of openings is made of iron, copper, aluminum, or alloy thereof.

16. The electrode connection structure of a speaker unit according to claim 14, wherein the electrode with the plurality of openings is made of metal fiber, oxide metal fiber, carbon fiber, or graphite fiber.

17. The electrode connection structure of a speaker unit according to claim 1, wherein the electrode with the plurality of openings comprises a non-conductive material layer and a conductive thin film.

18. The electrode connection structure of a speaker unit according to claim 17, wherein the conductive thin film is formed on a surface of the non-conductive material layer by plating.

19. The electrode connection structure of a speaker unit according to claim 17, wherein the non-conductive material layer and the conductive thin film are formed on the electrode layer by laminating.

20. The electrode connection structure of a speaker unit according to claim 17, wherein the non-conductive material is made of plastic, rubber, paper, or non-conductive cloth.

21. The electrode connection structure of a speaker unit according to claim 17, wherein the conductive thin film is made of a pure metal material such as aluminum, gold, silver, and copper, or an alloy thereof, a bi-metal material, a conductive oxide material such as indium tin oxide (ITO) and indium zinc oxide (IZO), a high molecular conductive material PEDOT, or a combination thereof.

* * * * *